US005546162A

United States Patent [19]

Michlin et al.

[11] Patent Number: 5,546,162

[45] Date of Patent: Aug. 13, 1996

[54] CONVERSION DEVICE AND KIT FOR CONVERTING A DOCTOR BLADE TO A SPREADER BLADE

[75] Inventors: Steven B. Michlin, 5310 Bentley Ste. 105, West Bloomfield, Mich. 47322; Michael F. Gaylord, Lakewood, Colo.

[73] Assignee: Steven Bruce Michlin, W. Bloomfield, Mich.

[21] Appl. No.: 460,096

[22] Filed: Jun. 2, 1995

[51] Int. Cl.[6] ..... G03G 21/00

[52] U.S. Cl. ..... 355/200; 355/245; 355/253

[58] Field of Search ..... 355/200, 245, 355/253, 260, 202; 118/261; 156/94

[56] References Cited

U.S. PATENT DOCUMENTS

| | | | |
|---|---|---|---|
| 5,006,898 | 4/1991 | Kobayashi et al. | 355/253 |
| 5,110,646 | 5/1992 | Prestel et al. | 355/245 X |
| 5,134,960 | 8/1992 | Shirai | 355/245 X |
| 5,223,068 | 6/1993 | Baley | 355/245 X |

FOREIGN PATENT DOCUMENTS 5-113719 5/1993 Japan .

*Primary Examiner*—Nestor R. Ramirez

[57] ABSTRACT

A conversion kit and method for converting the doctor blade of a toner cartridge for an imaging machine to a spreader blade. The conversion kit comprises an elastic strip of material, such as nonconductive urethane, with adhesive on one side to attach the elastic strip to a surface of the doctor blade. An assembly jig is provided to hold the doctor blade in position while applying the elastic strip. The jig is designed and sized to act as a guide for ensuring the accurate positioning of the elastic strip on the doctor blade. The jig has a groove to grasp the bent-over portion of the doctor blade, and a raised edge adjacent the groove against which the elastic strip is placed. The conversion kit further comprises washers approximately the same thickness as the elastic strip. The washers are adhered to the surface of the doctor blade at each end adjacent the elastic strip and in alignment with the holes for the screws used to fasten the doctor blade to the toner cartridge.

19 Claims, 11 Drawing Sheets

20b
20a
20i
20t
20h
24b
22b
23b
21b
11

FIG - 13
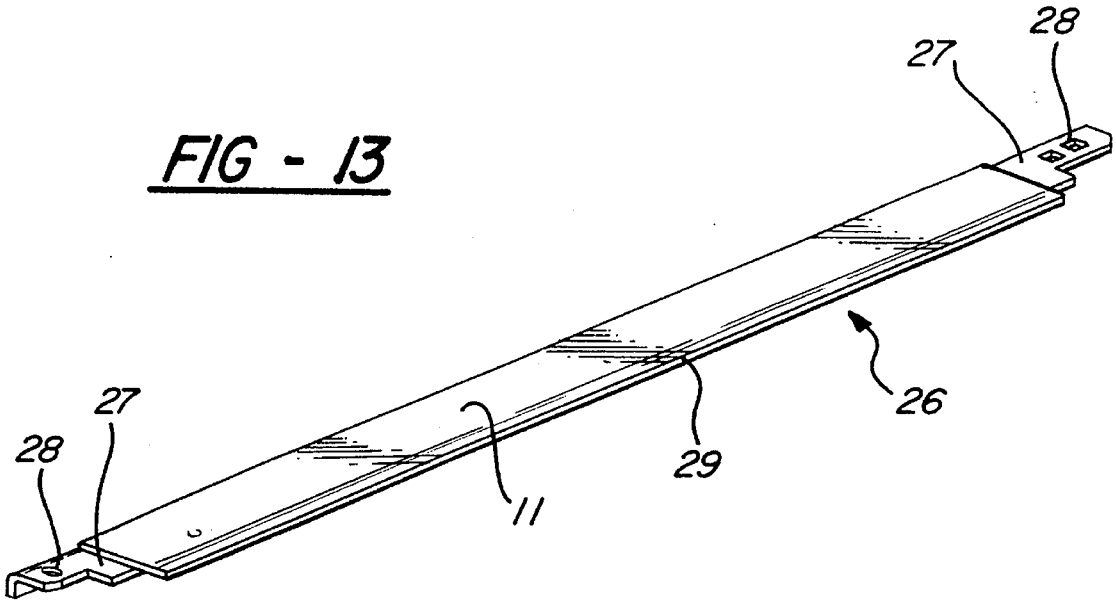
FIG - 14
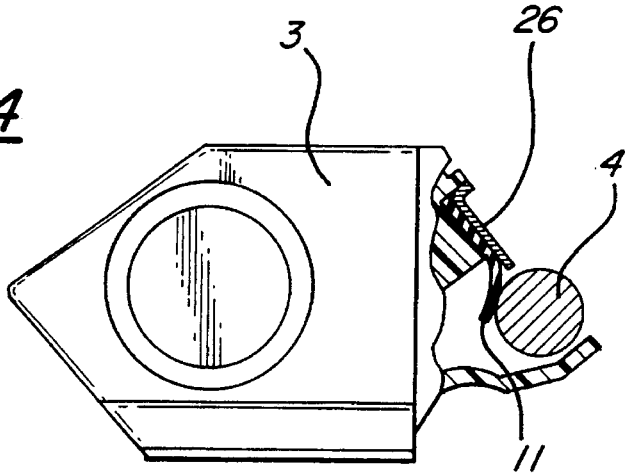
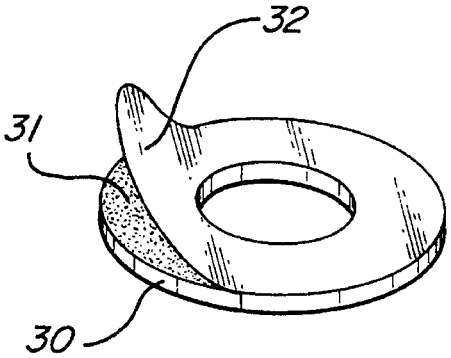
FIG - 15

CONVERSION DEVICE AND KIT FOR CONVERTING A DOCTOR BLADE TO A SPREADER BLADE

BACKGROUND OF THE INVENTION

This invention relates to solving problems in laser printers, copiers and facsimile machines, known as imaging machines, involving poor print quality. The problem actually occurs in a high percentage of toner cartridges that are used in the imaging machines. The major printer manufacturers include the popular HP Series 2 and Series 3 LASERJET series SX printers as well as some APPLE, QMS, CANON, and BROTHER SX printers. At the time of this writing, this SX printer is the most widely used printer worldwide, but its numbers are diminishing because the OEM manufacturers discontinued manufacturing it over three years ago. However, the numbers are so high that these SX printers will still be numerous for quite some time to come. For example, there are over 200 million SX toner cartridges out in the field since the printer first was released.

CANON has designed an all-in-one cartridge as in U.S. Pat. No. 4,975,744, issued Dec. 4 1990 and assigned to CANON. Several companies have used similar cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers began remanufacturing cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one toner cartridge of the "SX" engine variety, the most popular printer cartridge from around 1987 through 1995 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "OPTIVA" cartridge, further increasing the size as well as credibility of this relatively new industry, although OPTIVA has since been discontinued. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles. There is an inherent set of problems within the SX toner cartridge more specifically located in the toner hopper assembly.

First, "gapping" is required to properly install the doctor blade. This gapping takes extra time and is an inconvenience when remanufacturing the toner cartridge. Consequently, the toner cartridge remanufacturer may prefer a toner cartridge that does not require gapping whereas the OEM manufacturer may prefer a toner cartridge that does require gapping because of the deterrent it creates for remanufacturers.

Second, uneven and cloudy gray scales and solid black fills on the printed output paper often result from using the SX doctor blade. Third, the SX doctor blade, by scraping the toner, puts a strain on the rotation of the developer roller. Fourth, the doctor blade has to be adjusted in position to prevent variation in gap width between the metering edge of the doctor blade and the roller. When not properly adjusted, banding or uneven darkness of the print may occur on the output paper. Finally, the open cell foam that is required under the doctor blade to prevent toner leakage out of the toner hopper loses its resilience after time and fails to prevent toner leakage. Additionally, with a developer roller that turns easier, there is less pressure on the developer roller felt bearings and plastic spacer bushings and thus, leakage from the ends may be minimized. Applicant has U.S. Pat. No. 5,296,902 on a long-life design for these felt end bearings.

There is a need for a spreader blade usable in the SX toner hopper in place of the SX doctor blade which does not require gapping or adjusting, does not cause uneven solid printing, does not resist the rotation of the developer roller, and prevents toner leakage from beneath the blade without the need for open cell foam. Modifying the SX doctor blade to operate as a spreader blade would provide a simple, cost-effective solution to all the problems associated with the conventional SX doctor blade.

SUMMARY OF THE INVENTION

Accordingly, it is an object of this invention to provide a conversion kit for converting the SX doctor blade to a spreader blade so it evenly spreads toner over the developer roller rather than scrapes off the roller.

Another object of this invention is to provide a conversion kit which enables a doctor blade to be converted to a spreader blade easily and accurately.

A further object of this invention is to provide the SX toner hopper with a spreader blade that does not need to be gapped, allows the cartridge to print even solid gray and black regions, does not interfere with the rotation of the developer roller, does not need to be adjusted, prevents toner leakage, and may prevent excessive wear on the developer roller.

A still further object of this invention is to provide an easy method for modifying an SX doctor blade to operate with the inherent advantages of a spreader blade.

In carrying out this invention in the illustrative embodiment thereof, the plastic separators are removed from the ends of the SX doctor blade. The metal blade is then placed in a specially designed assembly jig and a nonconductive urethane strip is precisely adhered to a surface of the blade by two-sided tape. The urethane strip is wider than the doctor blade. Washers having the same or close to the same thickness as the strip are aligned with the screw holes on each end of the doctor blade and optionally adhered to the same surface of the blade. The modified doctor blade is then secured to the toner hopper with the strip between the blade and hopper and tucked under the developer roller.

The modified doctor blade acts as a spreader blade and evenly distributes the toner over the developer roller. The face of the urethane strip contacts the roller, so the modified doctor blade does not have to be gapped or adjusted to ensure the right distance between a metering edge and the roller. There is no longer a metering edge. Since the urethane strip is nonconductive, it will not interfere with the transfer of toner between the developer roller and the photoreceptor drum. Toner does not build-up on the urethane strip. The result is even darkness of the output. Toner cannot leak from beneath the blade into other areas of the cartridge and imaging machine. The spreading action of the urethane strip does not restrain the rotation of the developer roller.

Nobody has ever modified an adjustable doctor blade into a spreader blade. This is the unique feature of this invention. There are over 200 million SX toner cartridges which can benefit from this doctor blade to spreader blade invention.

BRIEF DESCRIPTION OF THE DRAWINGS

This invention, together with other objects, features, aspects, and advantages thereof, will be more clearly understood from the following description, considered in conjunction with the accompanying drawings.

FIG. 13 shows the modified blade removed from the assembly jig.

FIG. 14 illustrates how the modified blade is used to spread toner on the developer roller.

FIG. 15 shows a washer with adhesive on one side.

COMPLETE DESCRIPTION OF THE PREFERRED EMBODIMENT

Figure 1:
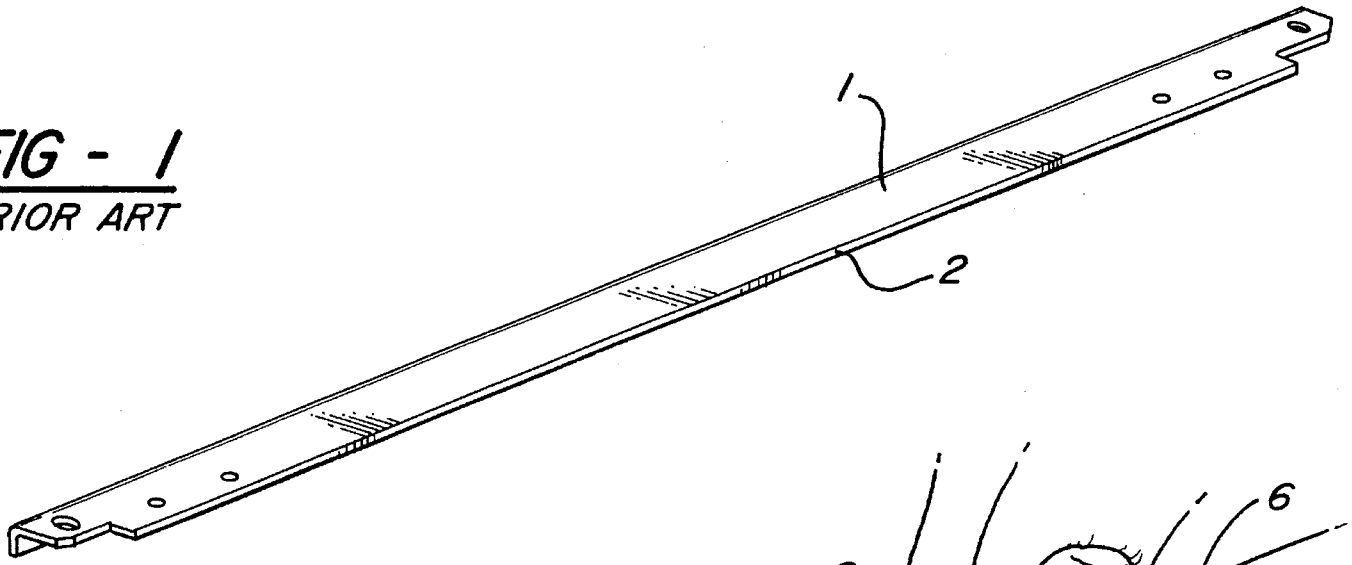
FIG - 1 PRIOR ART
FIG. 1 shows a conventional doctor blade used in an SX toner hopper.

Referring now to FIG. 1, a conventional metering or doctor blade 1 for use in the SX toner hopper (plastic separator not shown) is shown. The doctor blade 1 regulates the thickness of the layer of toner on the developer roller by scraping toner off the roller until the toner remaining on the roller is the correct thickness. The current or conventional doctor blade 1 in the SX toner hopper consists of an adjustable steel blade which allows a variable distance from a metering edge 2 to the surface of the developer roller. The doctor blade 1 is both magnetic (very slightly) and conductive. Some versions of the doctor blades 1 used in the many SX toner cartridges manufactured are only conductive, and since they are made of steel which contains iron, they attract toner which is magnetic because SX toner powder contains magnetic oxides of iron, otherwise known as oxides of magnetite. The magnetic property of the blade 1 assists in metering the toner.

Figure 2:
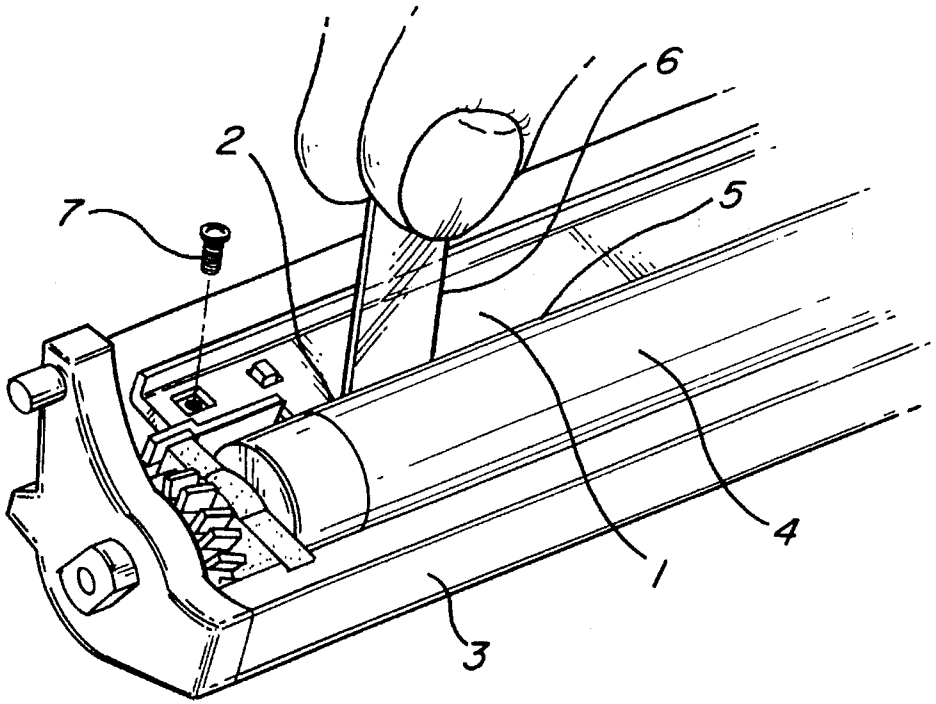
FIG - 2 PRIOR ART
FIG. 2 illustrates how the gap between the conventional doctor blade and developer roller is set.

FIG. 2 illustrates one end of part of an SX toner hopper 3 (which is an assembly in a toner cartridge) and a developer roller 4. The developer roller 4 is an aluminum tube with a magnetic internal core. During the operation of the toner hopper 3 within an imaging machine, a bias voltage is applied simultaneously to the doctor blade 1 and developer roller 4. This prevents discharge, because as the metering edge 2 of the blade 1 accumulates a layer of toner it can discharge the developer roller 4 and cause streaking on the output paper. The bias voltage is applied by an alternating current (AC) component of a power supply and oscillates between positive and negative several hundred cycles per second. This causes toner from a toner containment unit or reservoir within the hopper 3 to be repelled from and attracted to the developer roller 4 almost two thousand times per second.

There are five major problems or disadvantages associated with the design of the adjustable SX doctor blade 1. The first disadvantage is the imprecise procedure of setting the distance between the metering edge 2 of the blade 1 and the developer roller 4, referred to as "gapping" in the art. This procedure is broadly illustrated in FIG. 2. The thickness of the gap 5 between the metering edge 2 of the blade 1 and the developer roller 4 is critical in determining the print density on the output page. The gapping procedure comprises placing a spacer 6, usually a piece of plastic or metal with an appropriate thickness, between the doctor blade 1 and the developer roller 4. This sets the correct width of the gap 5 and is done at both ends of the roller 4. The doctor blade 1 is then held in place by hand and a holding screw 7 at each end of the blade i is used to secure the blade 1 to the toner hopper 3 and lock the blade 1 in place.

A gap width of ten-thousandths of an inch is the normal factory setting, but variations in this width sometimes occur. If a narrower gap 5 is used, a thinner supply of toner will be provided from the developer roller 4 to the photoreceptor drum (not shown). The print density and darkness of the print on the output paper will be decreased, and the toner yield per page is increased. The toner supply will last a longer time. On the other hand, if the width of the gap 5 is increased, a darker print density will be achieved since a thicker supply of toner will be provided from the developer roller 4 to the photoreceptor drum. The toner yield per page is decreased, shortening the life of the toner supply. According to rumor, some toner manufacturers provide a spacer 6 to toner cartridge remanufacturers which is greater in thickness than necessary so their customers will use toner at a faster rate, and thus will have to purchase more toner. Too wide a gap 5 may also cause small text letters on the output paper to bleed together. Wide gaps enable excess build-up of toner which eventually falls into the printer, causing background and streaking on the printed output. Also, if the gap is too wide, the outer regions of the toner layer are no longer "held" by the magnet core of the developer roller assembly. An overly wide gap causes "wavy" patterns in gray scale images and solid black fills. It should be pointed out that gray scale print is actually not gray, but consists of a grid of 300 dots per inch, or 90,000 dots per square inch, which itself consists of black and white pixels or dots. (Some SX printers have been modified to get better dot resolution such as 600 dots per inch or 360,000 dots per square inch.) By printing certain combinations of black and white dots on the grid, the eye is tricked into perceiving gray images. It is these images that are referred to throughout this patent application as gray scales, even though they actually consist of patterns of black and white dots. Setting the gap width requires labor and is very time consuming.

A second problem associated with using the conventional SX doctor blade is uneven and sometimes cloudy gray scales and solid black fills on the printed output paper. This may be attributed to the bias voltage when it is applied simultaneously to the doctor blade 1 and the developer roller 4. The bias voltage has an AC-component and a DC (direct current) component. The AC component changes from positive to negative at many cycles per second, so toner is repelled end attracted to the doctor blade at many cycles per second. As the toner jumps up and down between the blade 1 and roller 4, it constantly bombards the metering edge 2 of the doctor blade 1. Since the blade 1 is both conductive and magnetic, it allows a layer of toner to build-up on the metering edge 2 over time. This layer of toner is usually not uniform and the metering edge 2 becomes uneven. Toner stuck or caked on the blade 1 changes the gap width along the length of the metering edge 2. Toner build-up on the metering edge 2 causes it to become insulative and to resist the electrical current of the bias charge. So, in addition to causing uneven and sometimes cloudy gray scales and solid black fills on the printed output paper, toner accumulation on the metering edge 2 of the doctor blade 1 can cause the blade 1 to discharge the developer roller 4 and produce streaks on the output paper.

A third disadvantage arising from the use of the conventional SX doctor blade 1 is that it makes the developer roller 4 harder to rotate, putting a strain on the printer (or other imaging machine). As the developer roller 4 rotates, there is a mechanical resistance to this rotation from the doctor blade 1 as the blade 1 scrapes the excess thickness of toner off the roller 4. Initially, a very thick toner layer is attracted to the developer roller 4 because of the magnetic core of the roller 4 and the bias voltage. There are magnetic particles in the material used to make the toner. The toner wants to remain stuck to the roller 4. But part of the toner layer is scraped of doctored off the roller 4 by the blade 1 as the roller 4 rotates. The result is a specific thickness of toner on the developer roller 4 for transfer to the photoreceptor drum.

The strong magnetic attraction of the core magnet causes a thick layer of toner to build up on the sleeve 4. This action is similar to iron filings on a magnet. In the SX developer roller system, the positive magnetic polarity is very strong near the doctor blade. When the doctor blade scrapes off the thick layer of toner underneath, there is a mechanical resistance much like that of shoveling snow. Therefore, this layer causes a substantial amount of mechanical resistance. In this invention, toner is spread across the developer roller before it reaches the strong magnetic portion of the roller. Therefore, mechanical resistance is reduced. Additionally, the adjustable doctor blade contains gapping "separators" 16 on both ends. During adjustment, these separators 16 are often pressed against the developer roller, causing both friction and resistance. In this invention, the separators 16 are removed and a spreader blade rides against the developer roller, generating less friction than when using the separators 16. The easier rotation of the developer roller also allows the printer to operate more freely with less strain.

The photoreceptor drum is charged by the corona assembly in the imaging machine to a negative six-hundred volts DC to repel toner or a negative one-hundred volts DC to attract toner. As the AC component of the bias voltage applied to the developer roller 4 changes polarity from positive to negative or vice versa, toner is alternately attracted to or repelled from the developer roller. The drum will attract what it wants of this toner supply and repel what it does not want. This repulsion and attraction of toner between the developer roller 4 and photoreceptor drum happens 2,000 times per second. This generates what has been described as a "toner cloud". If the developer roller 4 does not rotate freely, the transfer of toner between the roller 4 and the photoreceptor drum can be alternately affected.

The adjustable property of the conventional SX doctor blade 1 leads to a fourth problem. The doctor blade 1, when not properly adjusted, provides variations in the gap width from one end of the developer roller 4 to the other. So the blade 1 would allow a thicker toner layer on one end of the roller. Banding may occur. This is when one side of the output page is darker than the other side. Coatings and improved contacts for the developer roller have reduced this problem, but an adjustable doctor blade will always be a possible culprit for banding. Although the thickness tolerance of the gapping tool is uniform in thickness from edge to edge, the doctor blade 1 is often torqued upward or downward when the holding screws 7 are tightened. Once banding occurs, the toner cartridge remanufacturer must disassemble the hopper 3, clean the metering edge 2 of the doctor blade 1, clean the developer roller, and reset the gap.

A fifth problem associated with the use of the conventional SX doctor blade 1 is toner leakage under the doctor blade. When the open cell foam under the doctor blade 1 compresses and loses its resilience, toner can leak from beneath the doctor blade 1 into the rest of the hopper 3. The toner can interfere with the operation of the corona assembly by fouling the corona wire, walls and grid. Toner which leaks from beneath the doctor blade can also land on the photoreceptor drum, ultimately causing streaks on the printed output page. Toner can also leak into the printer, causing a terrible mess. When toner leaks under the doctor blade, a toner cartridge remanufacturer must typically replace the cartridge for the customer at no charge. Some remanufacturers install an additional replacement strip of open cell foam under the blade 1, or completely replace the original foam.

Figure 3:
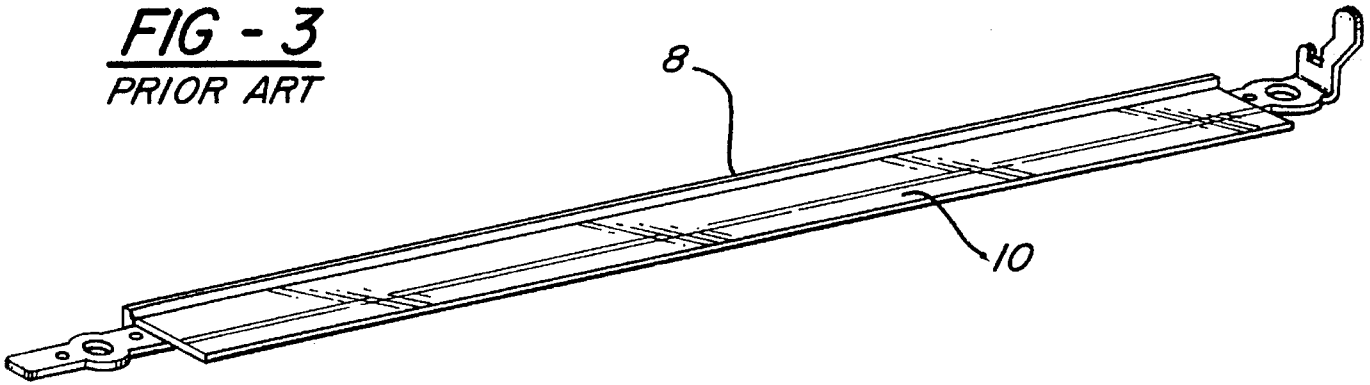
FIG - 3 PRIOR ART
FIG. 3 shows one type of prior art "LX" spreader blade.
Figure 4:
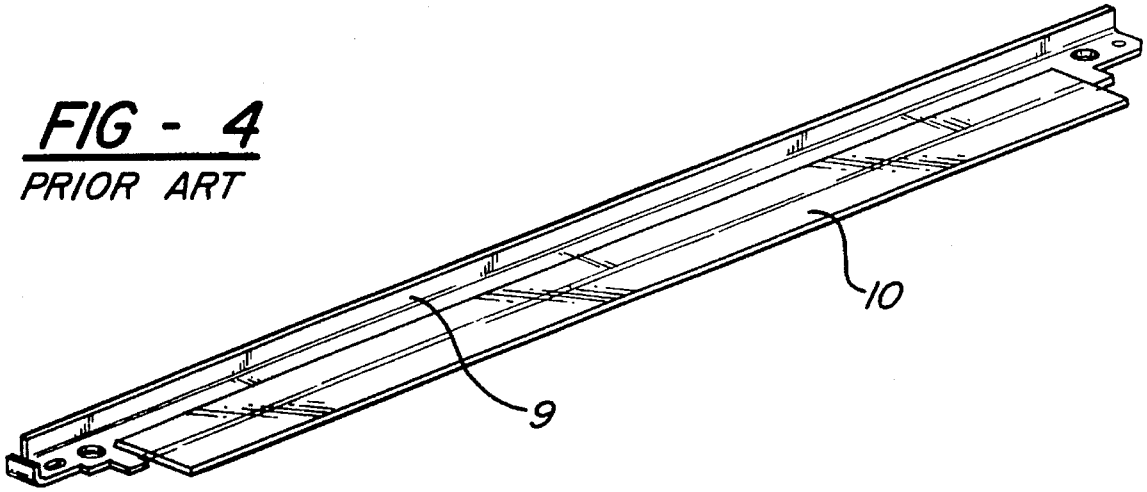
FIG - 4 PRIOR ART
FIG. 4 shows a second type of prior art "NX" spreader blade.

To solve these problems, the inventors of this application have developed a conversion kit and method to convert the SX doctor blade 1 to a spreader blade. Spreader blades have been used with great success, for example, in the CANON LX, NX, BX, PX and EX toner cartridges. Prior art FIG. 3 shows a conventional LX spreader blade 8 and prior art FIG. 4 shows a conventional NX spreader blade 9. These blades 8 and 9 each use a strip of urethane rubber 10 to spread the toner evenly and at the right thickness over the developer roller 4. Also, the "rubbing" action of the spreader blade against the developer roller 4 electrostatically charges the toner better than the adjustable doctor blade 1. The increase in the electrostatic charge allows the excited toner to transfer more freely to the drum. If toner is not properly charged by either the developer roller 4 or doctor blade 1, it will not be excited enough to properly jump across to the photoreceptor drum for high density images. Hence, the invention provides more friction against the developer roller 4 which creates greater triboelectric charges on the toner. But these spreader blades 8 and 9 cannot be used in the SX toner hopper. Over two-hundred million SX toner cartridges that have been manufactured to use the SX doctor blade 1 would be significantly improved if those doctor blades could be modified to function as spreader blades.

Figure 5:
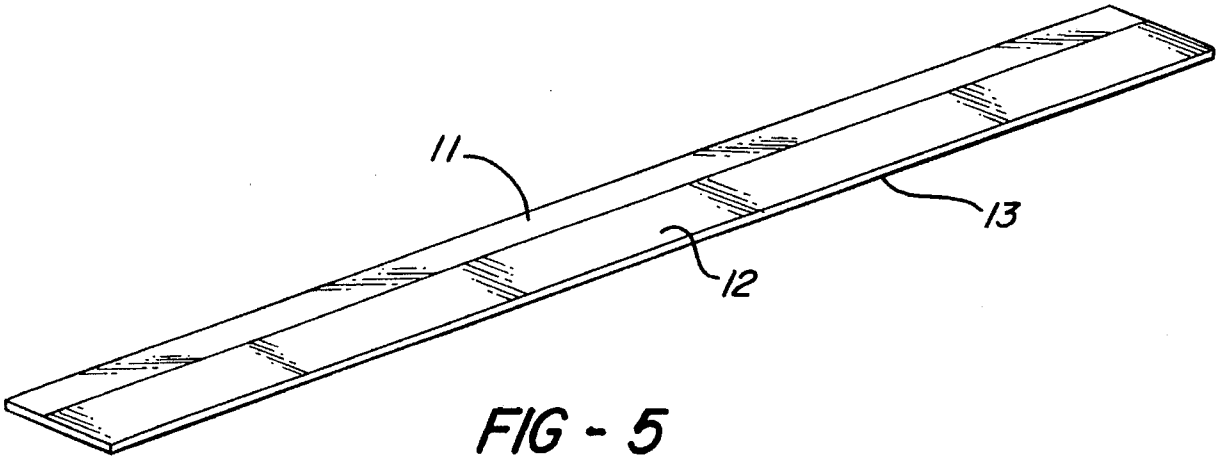
FIG. 5 illustrates the urethane strip used to modify the doctor blade.

FIG. 5 shows the nonconductive urethane rubber strip of this invention which will be used to convert the SX doctor blade 1 to a spreader blade. A conductive urethane strip could also be used, however, to prevent toner sticking to the strip 11 as in U.S. Pat. No. 5,400,128 issued Mar. 3, 1995 by one of the applicants. The urethane strip 11 is eight and twenty-one thirty-seconds inches long and seven-eighths of an inch wide, and very thin in cross-section. A piece of one-half inch wide two-sided tape 12 of the same length is placed on one side (top or bottom surface) of the urethane strip 11 such that the tape 12 extends along an edge 13 of the urethane strip 11. The backing of the two-sided tape 12 is left on until the urethane strip 11 is ready to be applied on the SX doctor blade 1.

Figure 6:
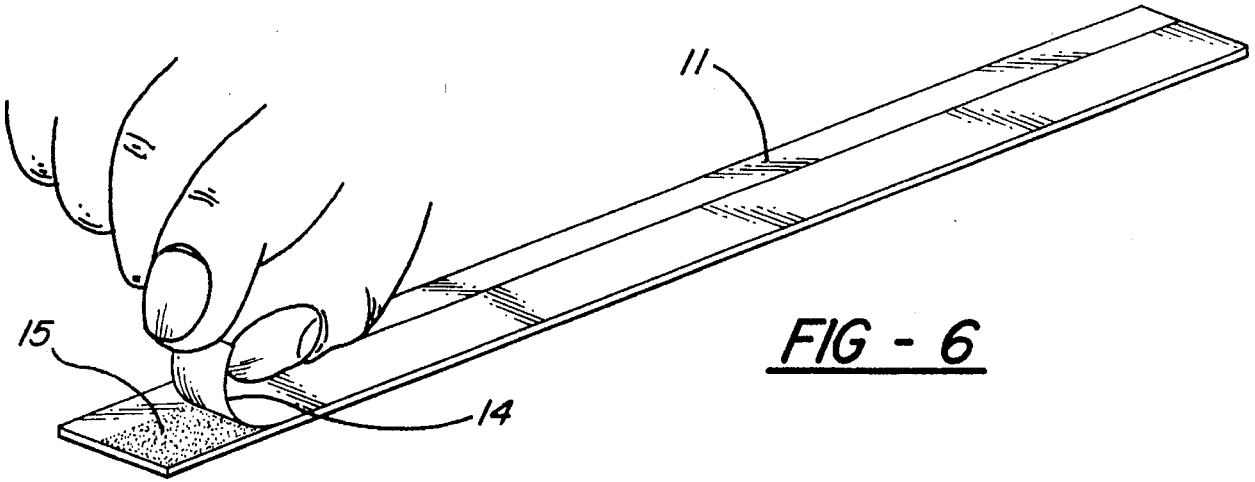
FIG. 6 demonstrates how two-sided tape is prepared to adhere the urethane strip to the doctor blade.

FIG. 6 demonstrates how the tape backing 14 is removed prior to attaching the urethane strip 11 to the blade 1, exposing the adhesive 15. Other adhesives such as glue could be used instead of the two-sided tape 12, but the two-sided tape works best and enables the urethane strip 11 to be easily shipped to customers as ready to apply.

Figure 7:
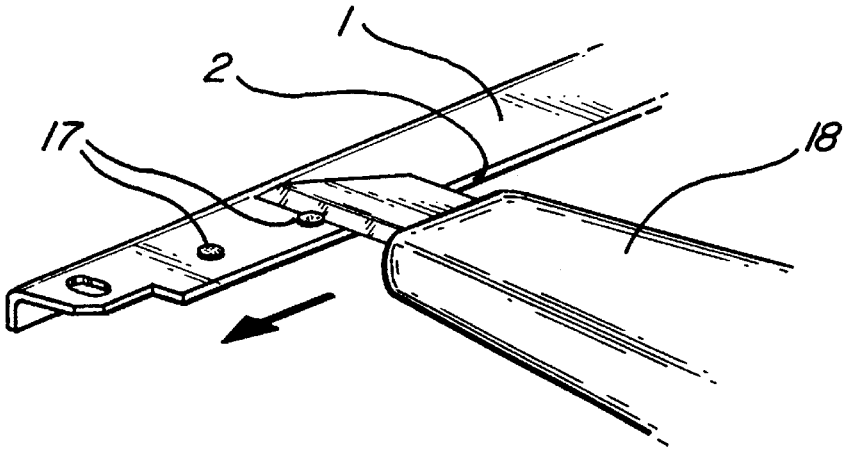
FIG. 7 shows how the nubs used to attach the separators to the doctor blade are cut.
Figure 8:
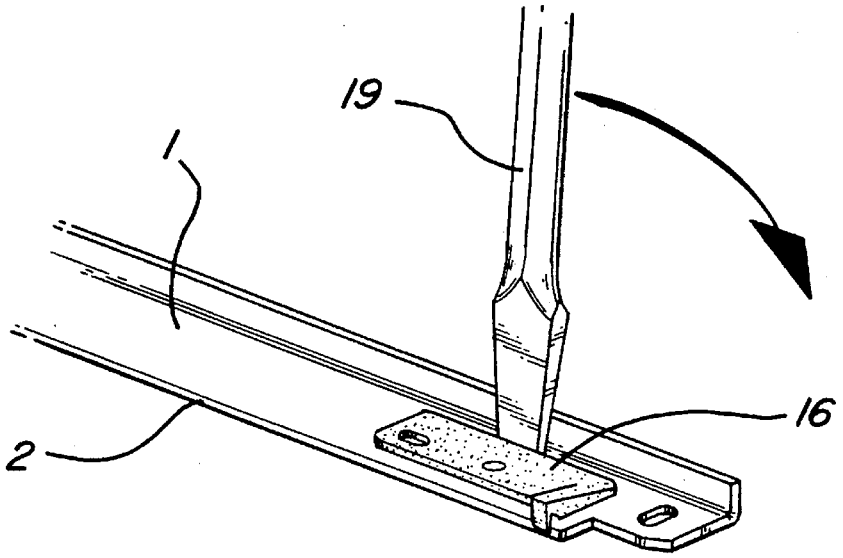
FIG. 8 shows how the separators are pried off the doctor blade.

FIGS. 7 and 8 illustrate how the SX doctor blade 1 is prepared to receive the urethane strip 11. There is a plastic separator 16 on each end of the blade 1 used to ensure the metering edge 2 of the blade 1 does not contact the developer roller 4 if the blade 1 loosens or is improperly gapped. The separators 16 are secured to the doctor blade 1 by nubs 17 extending through holes in the blade 1. In the method of converting the SX doctor blade 1 to a spreader blade, the nubs 17 are cut off by a box knife 18 and the separators 16 are then pried off with a screwdriver 19. The separators 16 will not be needed and, by removing the separators 16, the hubs 17 will not interfere with the attachment and function of the urethane strip 11.

Figure 9:
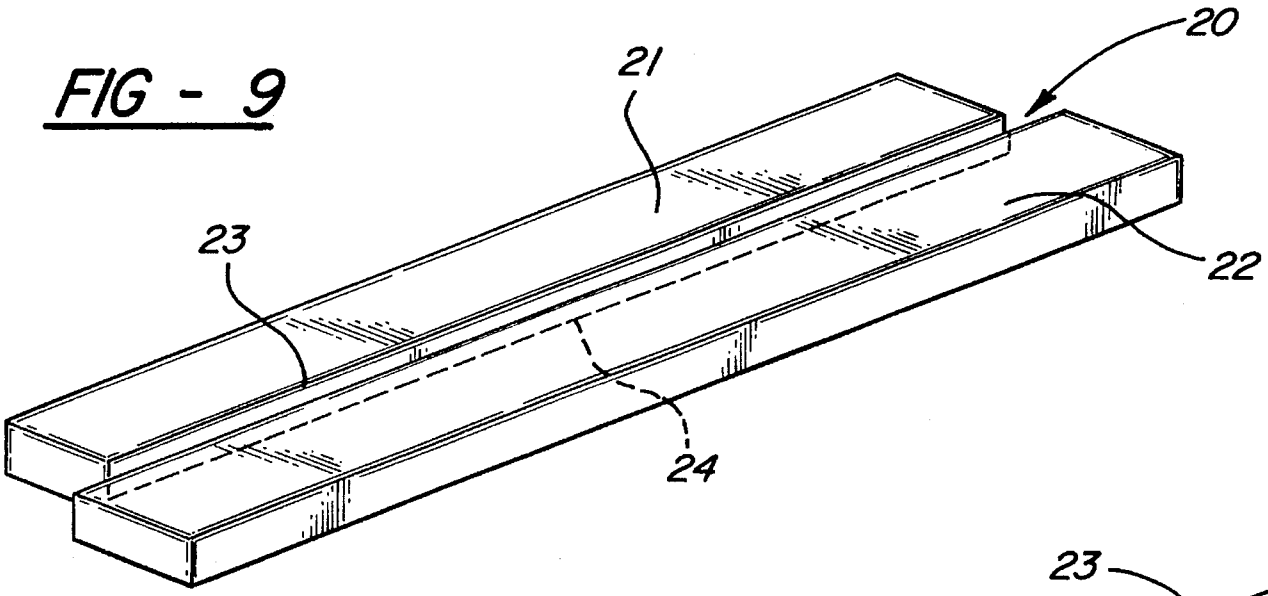
FIG. 9 illustrates an assembly jig of the conversion kit.

An assembly jig has been designed to help the user precisely and easily attach the urethane strip 11 to the doctor blade 1. FIG. 9 shows the assembly jig 20. The jig 20 is a block of material such as wood, plastic, plaster, or metal such a steel aluminum, brass, bronze or other metal having two parts. A first part 21 is eight and twenty-one thirty-seconds inches long, the exact length of the urethane strip 11. A second part 22 is the exact length of the SX doctor blade 1, approximately ten and one-sixteenth inches long. The second part 22 is thinner or shorter in height than the first part 21 such that the first part 21 forms a raised edge 23. There is a groove 24 at least an eighth of an inch deep and about one thirty-second of an inch wide where the first part 21 and the second part 22 join. The dimensions may vary somewhat, plus or minus to fit properly, with minor adjustments and it would still function well. Also, this device may be used to upgrade other similar imaging devices.

Figure 10:
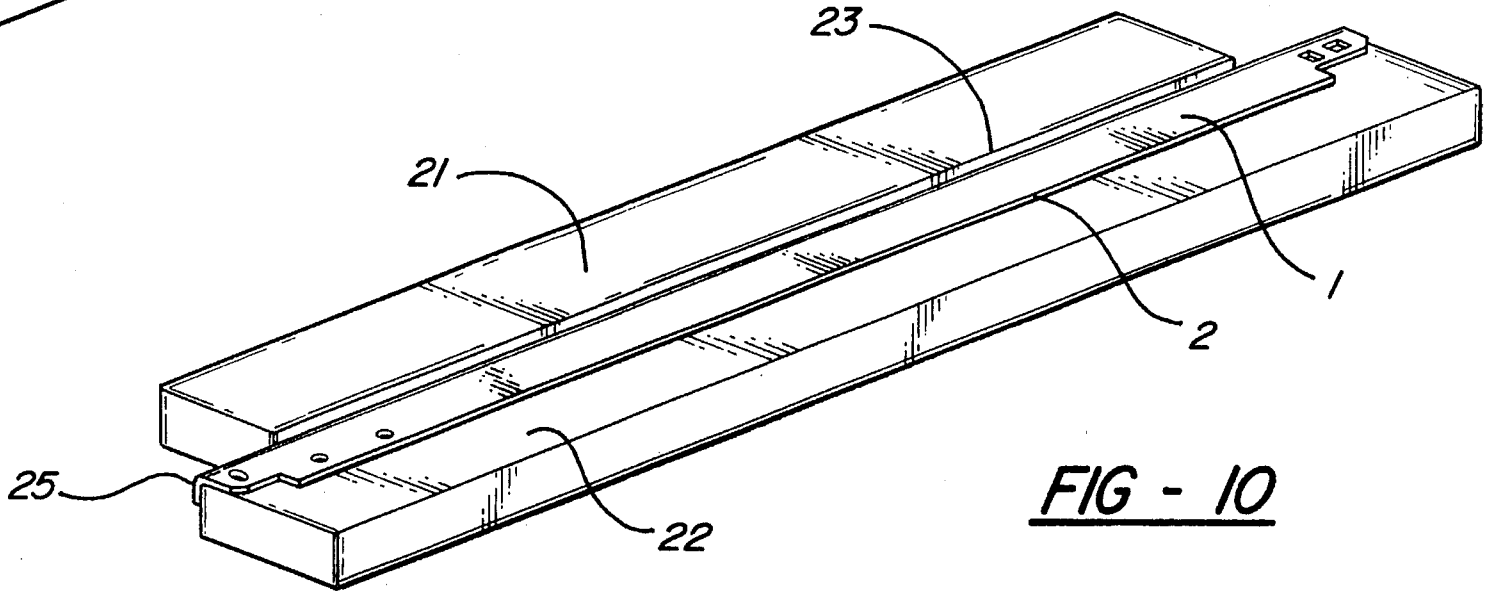
FIG. 10 demonstrates how the doctor blade is positioned on the assembly jig.
Figures 9A, 11A, 12A:
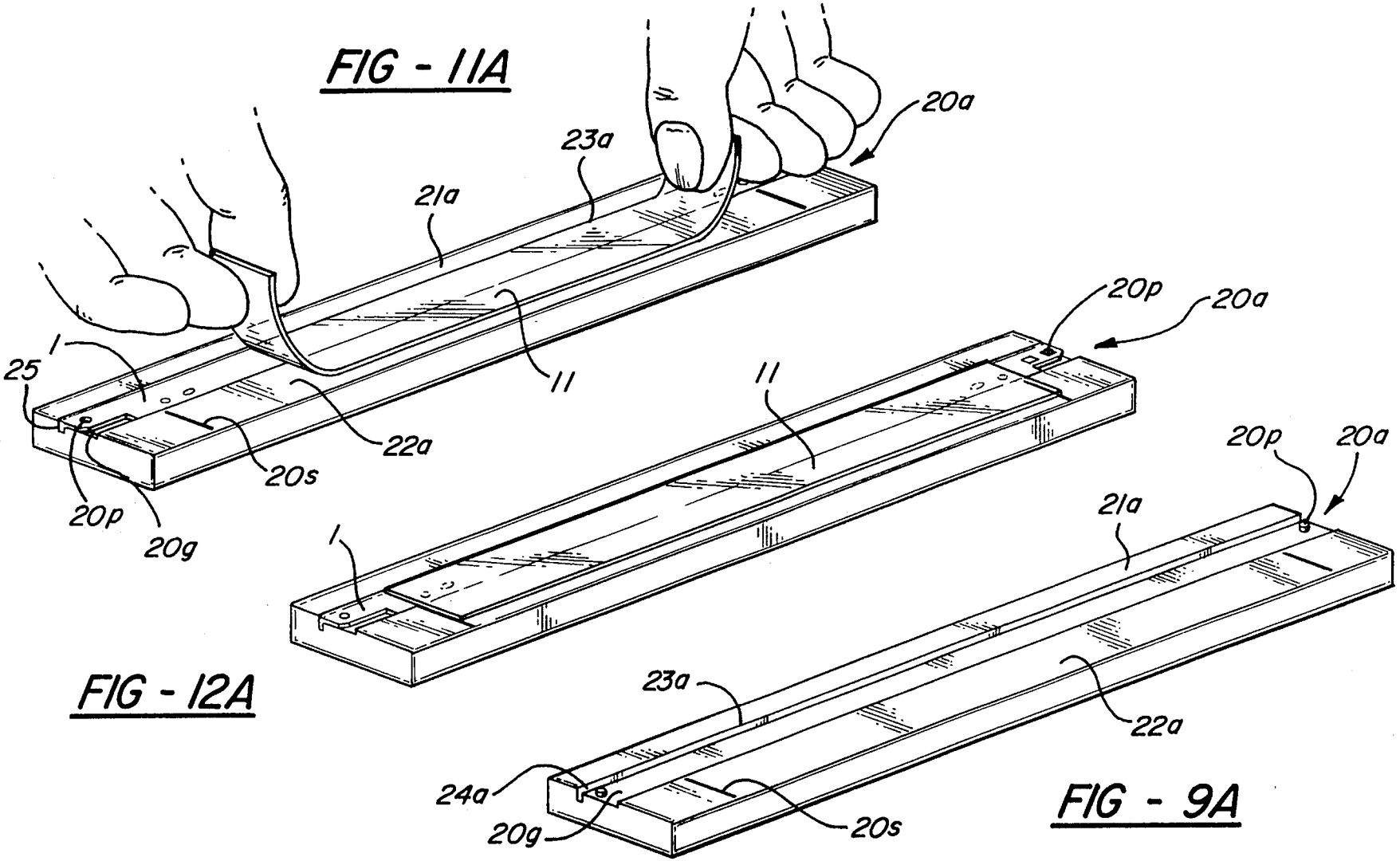
FIG. 9A illustrates an assembly jig of the conversion kit.
FIG. 11A illustrates another method of attaching the urethane strip to the doctor blade.
Figures 9B, 11B, 12B:
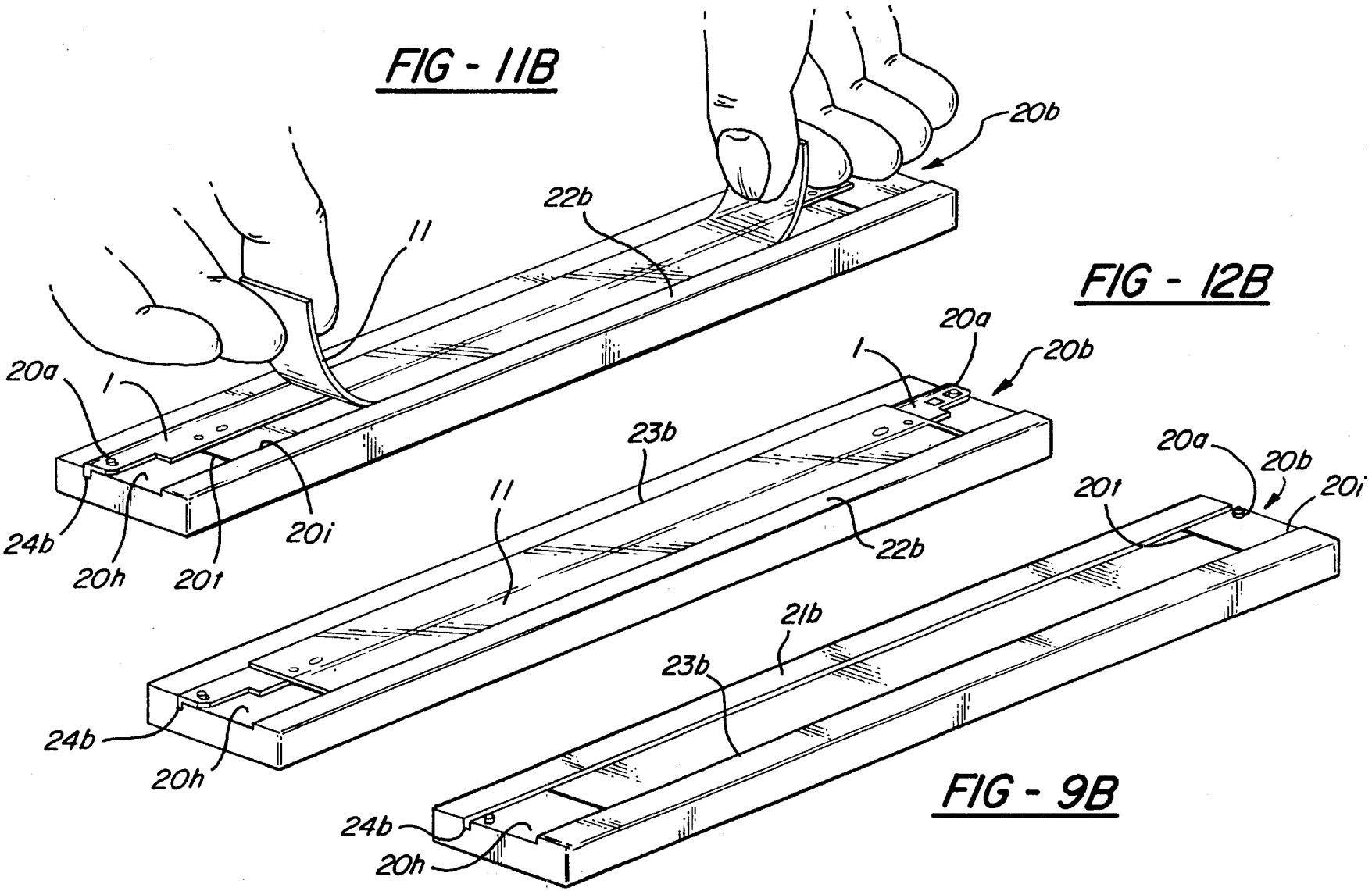
FIG. 9B illustrates an assembly jig of the conversion kit.
FIG. 11B illustrates another method of attaching the urethane strip to the doctor blade.
Figures 9C, 11C, 12C:
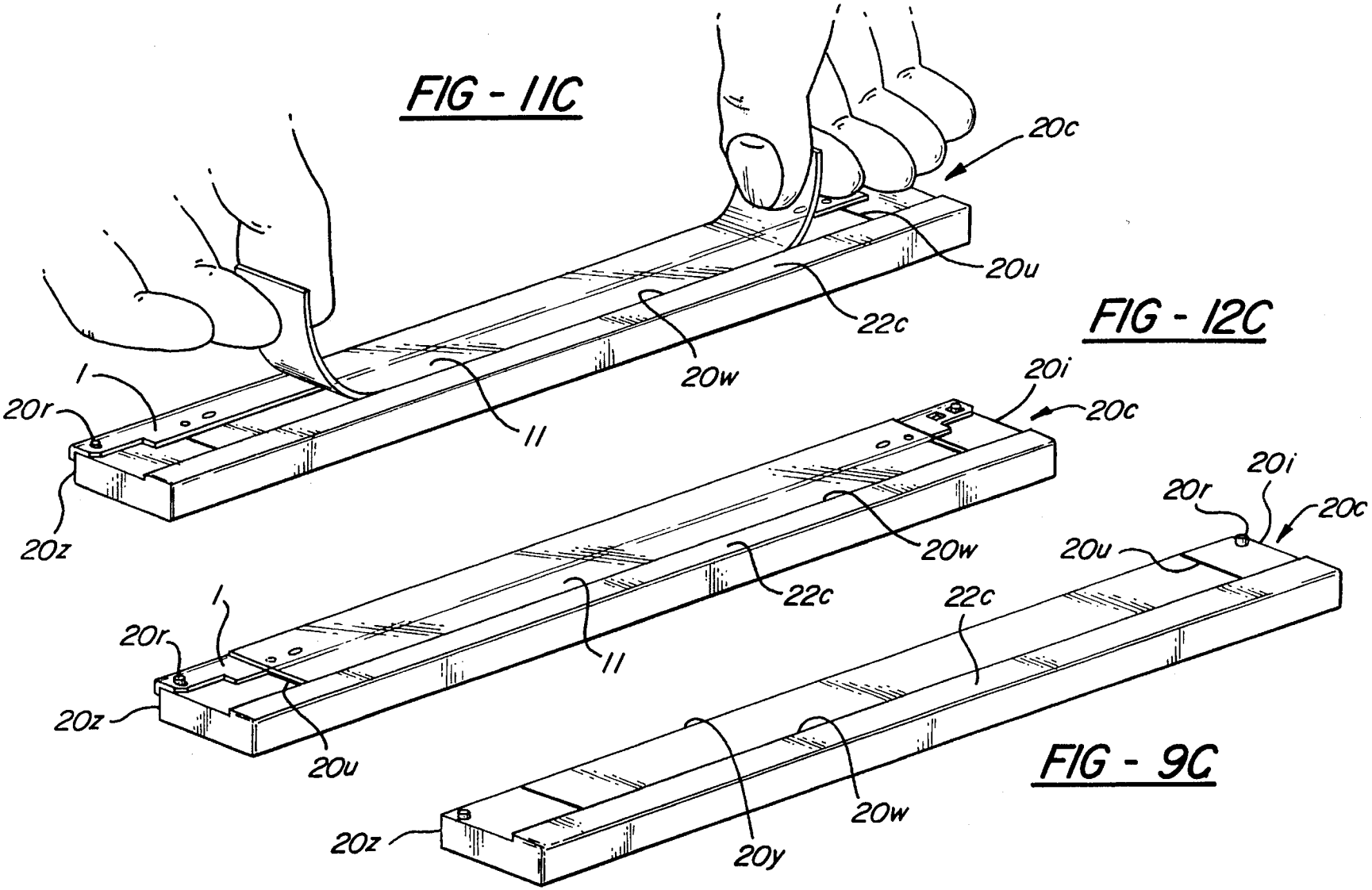
FIG. 9C illustrates an assembly jig of the conversion kit.
FIG. 11C illustrates another method of attaching the urethane strip to the doctor blade.
Figure 11:
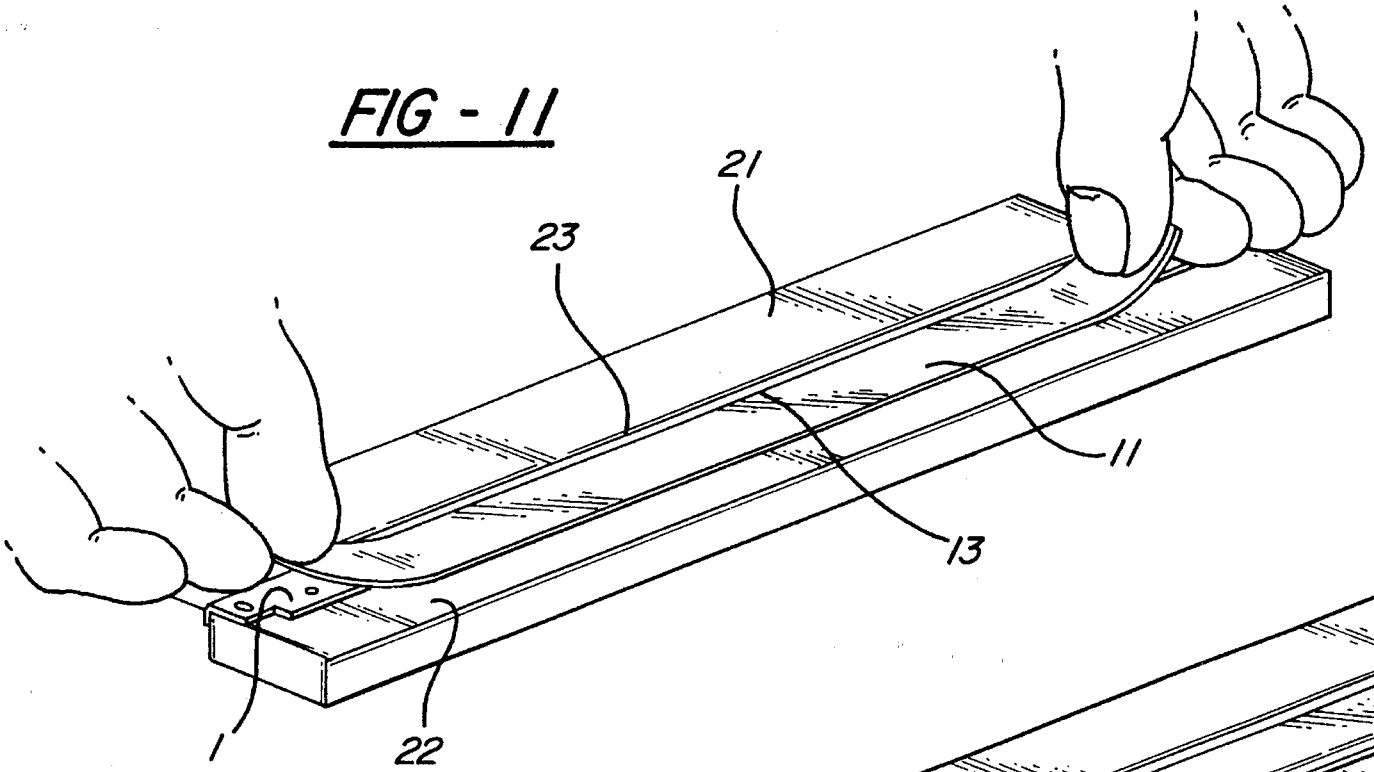
FIG. 11 illustrates one method of attaching the urethane strip to the doctor blade.
Figure 12:
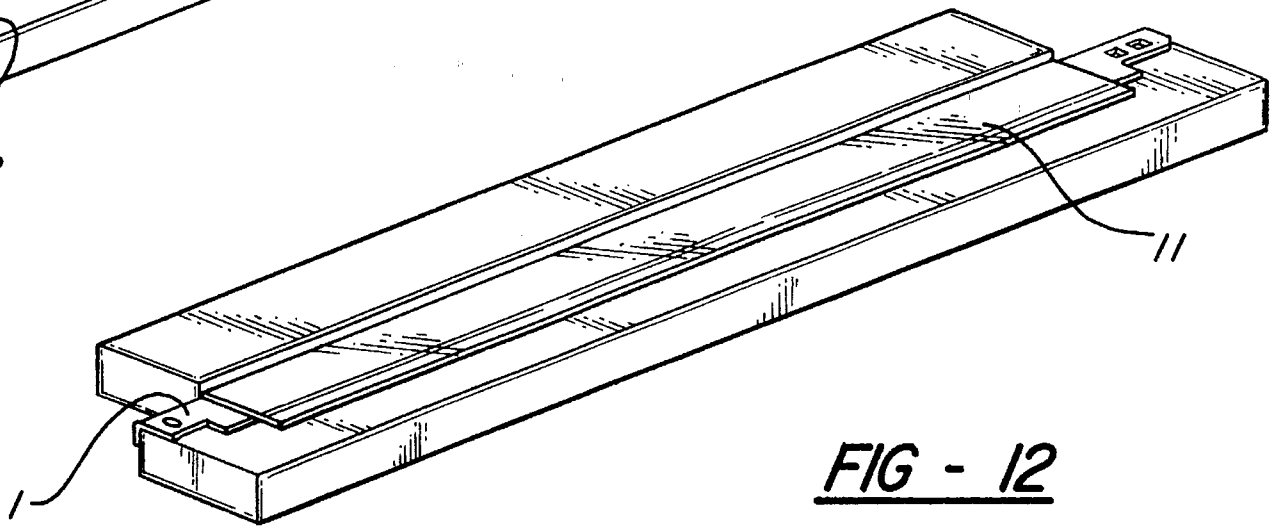
FIG. 12, 12A, 12B, 12C shows how the assembly jig is used to precisely position the urethane strip on the doctor blade.

As illustrated in FIG. 10, the SX doctor blade 1 is placed on the assembly jig 20 such that the bent-over edge portion 25 of the blade 1 extends into the groove 24 of the jig 20 and the ends of the blade 1 are flush with the ends of the second part 22 of the jig 20. The urethane strip 11, with the backing 14 of the two-sided tape 12 removed as demonstrated in FIG. 6, is then adhered to the doctor blade 1. This is illustrated in FIGS. 11 and 12. The edge 13 is of the urethane strip 11 is placed against the raised edge 23 of the first part 21 of the jig 20, and the ends of the urethane strip 11 are lined up flush with the ends of the first part 21 of the jig 20. In this way, the urethane strip 11 is precisely located on the doctor blade 1.

A second embodiment of the assembly jig has been designed to help the user precisely and easily attach the urethane strip 11 to the doctor blade 1. FIG. 9A shows the assembly jig **20*a*. The jig 20*a* is a block of material such as wood, plastic, plaster, or metal such a steel aluminum, brass, bronze or other metal having two parts, preferably metal. A first part 21*a* has a raised height to act as a stop or guide. A second part 20*g* is the exact length of the SX doctor blade 1, approximately ten and one-sixteenth inches long. The second part 22*g* is thinner or shorter in height than the first part 21*a* such that the first part 21*a* forms a raised edge 23*a*. Region 20*g* forms a slot. There is a groove 24*a* at least an eighth of an inch deep and about one thirty-second of an inch wide where the first part 21*a* and the second part 20*g* join. The dimensions may vary somewhat, plus or minus to fit properly, with minor adjustments and it would still function well. A third part 22*a* is raised relative to the second part 20*g* to fit the width of the stripped doctor blade 1. Also, this device may be used to upgrade other imaging devices. A scratch mark 20*s* has been inscribed to mark the precise location of the urethane strip 11 for accurate positioning. The channel 20*g* is for making the surfaces of the SX doctor blade 1 and the second portion 22*a* coplaner so the urethane strip 11 will fit nicely. Also, the pins, 20*p* have been added to "lock in" the SX doctor blade 1** for accurate positioning. The pins are optional, since this design would function without the pins.

As illustrated in FIG. 11A, the SX doctor blade 1 is placed on the assembly jig **20*a* such that the bent-over edge portion 25 of the blade 1 extends into the groove 24*a* of the jig 20*a* and the ends of the blade 1 are flush with the ends of the second part 22*a* of the jig 20*a*. The urethane strip 11, with the backing 14 of the two-sided tape 12 removed as demonstrated in FIG. 6, is then adhered to the doctor blade 1. This is illustrated in FIGS. 11A and 12A. The edge 13 of the urethane strip 11 is placed against the raised edge 23*a* of the first part 21*a* of the jig 20*a*, and the ends of the urethane strip 11 are lined up flush with the scratch marks 20*s* of the third part 22*a* of the jig 20*a*. In this way, the urethane strip 11 is precisely located on tile doctor blade 1**.

A third assembly jig has been designed to help the user precisely and easily attach the urethane strip 11 to the doctor blade 1. FIG. 9B shows the assembly jig **20*b*. The jig 20*b* is a block of material such as wood, plastic, plaster, or metal such a steel aluminum, brass, bronze or other metal having two parts, preferably metal. A first part 22*b* has a raised height to act as a stop or guide. A second part 20*h* is the exact length of the SX doctor blade 1, approximately ten and one-sixteenth inches long. The second part 20*h* (and 21*b*) is thinner or shorter in height than the first part 22***b* such that the first part 22*b* forms a raised edge 23*b*. Region 20*h* and 21*b* are coplanar and lower than the first part 22*b*. There is a groove 24*b* at least an eighth of an inch deep and about one thirty-second of an inch wide where the third part 21*b* and the second part 20*h* join. The dimensions may vary somewhat, plus or minus to fit properly, with minor adjustments and it would still function well. Also, this device may be used to upgrade other imaging devices. A scratch mark 20*t* has been inscribed at each end to mark the precise location of the ends of the urethane strip 11 for accurate positioning. Also, the pins, 20*q* have been added at each end to "lock in" the SX doctor blade 1 for accurate positioning. The pins are optional, since this design would function without the pins.

As illustrated in FIG. 11B, the SX doctor blade 1 is placed on the assembly jig 20*b* such that the bent-over edge portion 25 of the blade 1 extends into the groove 24*b* of the jig 20*b* and the ends of the blade 1 are flush with the ends of the second part 20*h* of the jig 20*b*. The urethane strip 11, with the backing 14 of the two-sided tape 12 removed as demonstrated in FIG. 6, is then adhered to the doctor blade 1. This is illustrated in FIGS. 11B and 12B. The edge 13 is of the urethane strip 11 is placed against the raised edge 23*b* of the first part 23*b* of the jig 20*b*, and the ends of the urethane strip 11 are lined up flush with the inscribed scratch marks 20*t* at each end. In this way, the urethane strip 11 is precisely located on the doctor blade 1.

A fourth assembly jig has been designed to help the user precisely and easily attach the urethane strip 11 to the doctor blade 1. This embodiment is the optimum device for placing the urethane strip 11 onto the doctor blade 1. FIG. 9C shows the assembly jig 20*c*. The jig 20*c* is a block of material such as wood, plastic, plaster, or metal such a steel aluminum, brass, bronze or other metal having two parts, preferably metal. A first part 22*c* has a raised height to act as a stop or guide. A second part 20*i* is the exact length of the SX doctor blade 1, approximately ten and one-sixteenth inches long. The second part 20*i* is thinner or shorter in height than the first part 22*c* such that tile first part 22*c* forms a raised edge 20*w*. This version, has no slot like the other embodiments, and is therefore, easier to manufacture. The pins 20*r* lock the SX doctor blade 1 for accurate positioning. The dimensions may vary somewhat, plus or minus to fit properly, with minor adjustments and it would still function well. Also, this device may be used to upgrade other imaging devices. A scratch mark 20*u* has been inscribed at each end to mark the precise location of the urethane strip 11 for accurate positioning. Also, the pins, 20*r* have been added to "lock in" the SX doctor blade 1 for accurate positioning. The pins are optional, since this design would function without the pins.

As illustrated in FIG. 11C, the SX doctor blade 1 is placed on the assembly jig 20*c* such that the bent-over edge portion 25 of the blade 1 extends into the edge 20*y* of the jig 20*c* and the ends of the blade 1 are flush with the ends of the second part 20*i* of the jig 20*c* at the end edge 20*z*. The urethane strip 11, with the backing 14 of the two-sided tape 12 removed as demonstrated in FIG. 6, is then adhered to the doctor blade 1. This is illustrated in FIGS. 11C and 12C. The edge 13 is of the urethane strip 11 is placed against the raised edge 20*w* of the first part 22*c* of the jig 20*c*, and the ends of the urethane strip 11 are lined up flush with the scratch marks 20*u* inscribed on the second part 20*i* of the jig 20*c*. In this way, the urethane strip 11 is precisely located on the doctor blade 1.

FIG. 13 shows the modified blade 26 removed from the assembly jig 20, 20*a*, 20*b*, or 20*c*. Note that the urethane strip 11 causes the surface 27 of the blade 26 to be no longer flat at the ends of the blade 26. This is the underside of the blade 26. In other words, as illustrated in FIG. 14, the surface 27 of the modified blade 26 to which the urethane strip 11 is attached is the surface which abuts against the hopper 3 when the blade 26 is attached to the hopper. Since the surface 27 is no longer flat, when the holding screws 7 are inserted through the holes 28 in the blade ends to secure the blade 26 to the toner hopper 3, the blade 26 may be torqued or otherwise moved out of its proper position. The urethane strip 11 may also become pinched, giving it an uneven spreading edge 29.

Figure 16:
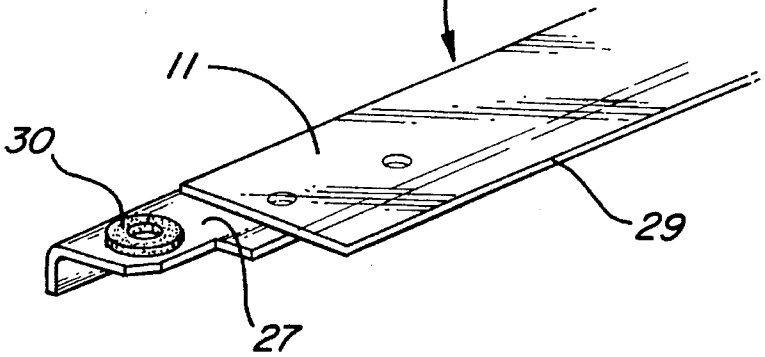
FIG. 16 shows how the washer of FIG. 15 is used on the modified blade to provide an even surface for attachment to the toner hopper.

FIG. 15 shows a washer 30 which is used, as part of the conversion kit, to prevent these problems. The washer 30 is the same thickness, or close to the same thickness as the urethane strip 11 and preferably has two-sided tape 31 with a peel off backing 32 on one side for securing the washer 30 to the blade 26. Other types of adhesive, such as glue, could be used in place of the two-sided tape 31. The washer may also work well without glue or adhesive, but gluing the washer 30 to the blade 26 makes it much easier to install the spreader blade. As illustrated in FIG. 16, the washer 30 is adhered to the surface 21 of the modified blade 26 such that it is aligned over the hole 28 in the end of the blade 26. A washer 30 is used at each end of the blade. The washers 30 make the surface 27 flat at the locations of the holding screws 7 and urethane strip 11, preventing improper positioning and warping, bowing or otherwise deforming of the modified blade 26 and unevenness of the spreading edge 29. Without the washer 30, a person installing the spreader blade 26 could accidently torque down too tight with the holding screws 7, warp the metal frame 27 of the spreader blade 26, and thus cause an undesirable toner leak under the spreader 26. Such leaks have been actually simulated in tests which led to the addition of the washer.

Figure 17:
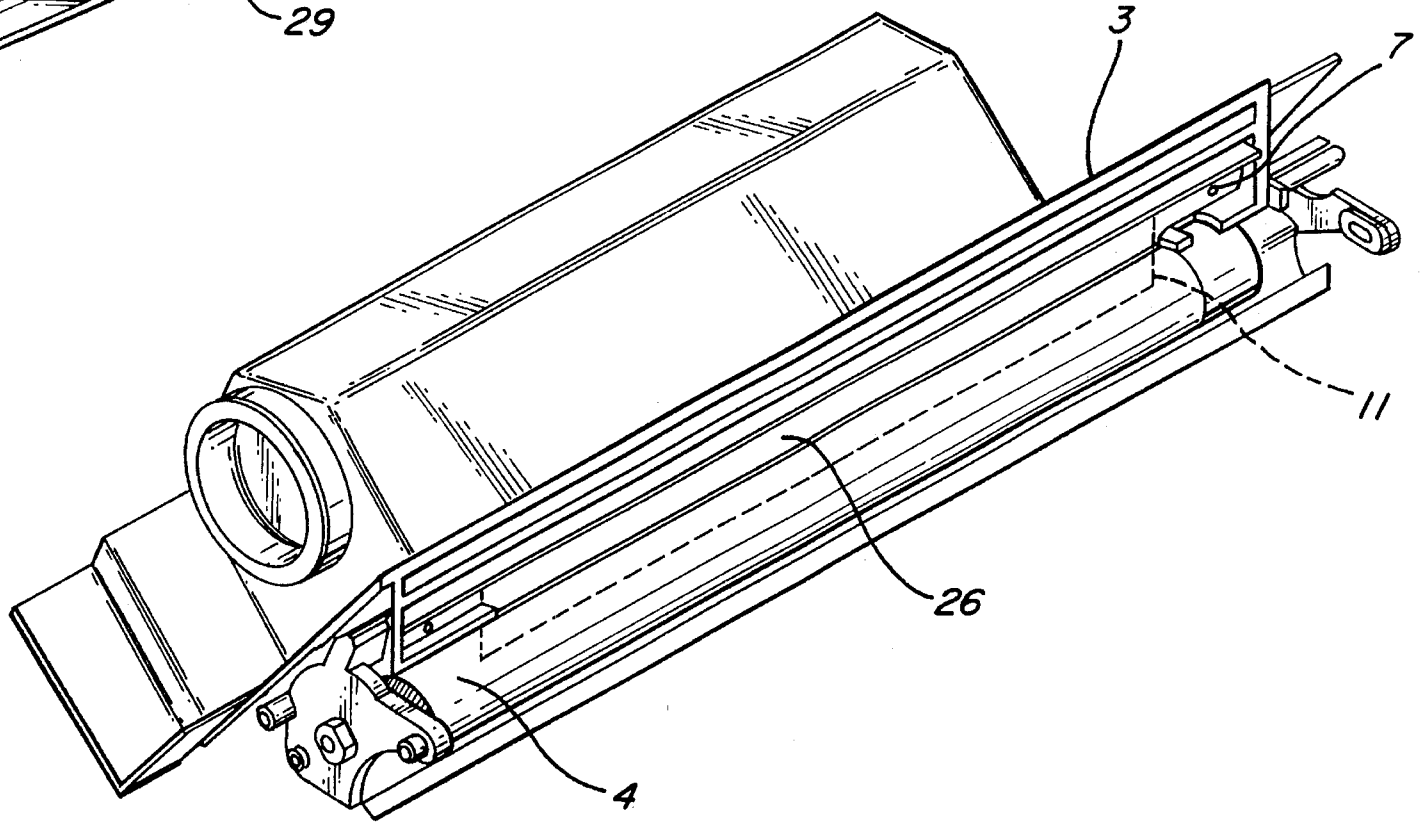
FIG. 17 illustrates the modified blade of the invention mounted on the toner hopper adjacent the developer roller.

FIG. 17 shows the modified blade 26 in position on the toner hopper 3. The SX doctor blade 1 has been converted to a spreader blade 26. As suggested by FIG. 14, the spreader blade 26 does not have to be gapped. It contacts the toner layer on the surface of the developer roller 4 to evenly spread the toner to a uniform, correct thickness. The spreader blade 26 does not scrape toner off the roller. A wide surface area of the urethane strip 11 is used rather than a sharp-edged blade. So the spreader blade 26 eliminates problems associated with Having to gap a doctor blade 1.

Toner does not stick to the nonconductive urethane strip 11 Since the strip 11 is insulative, it will not have any influence on the toner transfer between the developer roller 4 and photoreceptor drum implemented by the bias voltage. The spreader blade 26 will not discharge the roller 4. Solid, even gray scales and black fills will be printed, and streaks will not occur because toner does not build-up on the urethane strip 11. The urethane strip 11 covers the holes where the nubs 17 were at the end of the SX doctor blade 1.

Since the spreader blade 26 is elastic and spreads or distributes the toner rather than scrapes the toner, there is less mechanical resistance against the rotation of the roller 4 and, therefore, less strain on the printer. The removal of the separators 16 from the blade also reduces friction between the blade 26 and roller 4.

Converting the SX doctor blade 1 to a spreader blade 26 means that adjusting the doctor blade is no longer necessary. Banding, caused by a doctor blade which needs adjustment, will no longer occur. The rubbery consistency of the urethane strip 11 allows the spreader blade 26 to prevent toner leakage from underneath the blade. The strip 11 acts as a gasket, eliminating the need for adding or replacing open cell foam.

With the old doctor blade, sometimes larger particles of toner would get caught between the metering edge 2 of the blade 1 and the developer roller 4. As the outer part of these toner particles wore away, the oxides of iron encapsulated within the toner particles would be released. These oxides of iron are abrasive, and they caused excessive wear on the developer roller, significantly shortening its life. By modifying the doctor blade to use the elastic urethane strip to evenly spread the toner, there is no metering edge to trap the larger particles. So the iron oxides will less likely be released and excessive wear on the roller may be prevented, lengthening the life of the developer roller.

Please note that other materials may also be used in place of the urethane rubber strip 11. For example, any plastics or any rubberlike material could have been used instead. For example, VINYL, PVC, POLYESTER, MYLAR, ACETATE, POLYCARBONATE, PETG, for example could be used. Some such materials would have to be adjusted for thickness so as not to be too tight on the developer roller. There is no limit of materials.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents the claimed elements.

What is claimed is:

1.) A conversion kit for converting a doctor blade of a toner hopper of an imaging machine to a spreader blade, said conversion kit comprising an elastic strip with attachment means for securing said elastic strip to said doctor blade, further comprising an assembly jig with holding means for supporting said doctor blade and allowing said elastic strip to be accurately positioned on said doctor blade prior to mounting in operating position.

2.) A conversion kit as in claim 1 wherein said elastic strip is made of nonconductive urethane.

3.) A conversion kit as in claim 2 wherein said attachment means is an adhesive.

4.) A conversion kit as in claim 3 wherein said adhesive is two-sided tape.

5.) A conversion kit as in claim 4 wherein said two-sided tape extends along an edge of said elastic strip.

6.) A conversion kit as in claim 5 wherein said elastic strip is wider than said two-sided tape.

7.) A conversion kit as in claim 1 wherein said attachment means is an adhesive.

8.) A conversion kit as in claim 7 wherein said adhesive extends along an edge of said elastic strip.

9.) A conversion kit as in claim 1 wherein said holding means of said assembly jig is a groove for receiving a portion of said doctor blade, and said assembly jig has a raised edge adjacent said groove against which said elastic strip is placed when securing said elastic strip to said doctor blade.

10.) A conversion kit as in claim 9 wherein said assembly jig comprises a first part joined to a second part, said second part being shorter in height than said first part such that said first part forms said raised edge adjacent said groove.

11.) A conversion kit as in claim 10 wherein said first part of said assembly jig is the same length as said elastic strip and said second part is the same length as said doctor blade, whereby said first and second parts of said assembly jig are used as guides to accurately position said elastic strip on said doctor blade.

12.) A conversion kit as in claim 1 wherein said attachment means secures said elastic strip to a surface of said doctor blade which abuts against said toner hopper when said doctor blade is fastened to said toner cartridge.

13.) A conversion kit as in claim 12 wherein said doctor blade is secured to said toner cartridge by screws extending through holes in each end of said doctor blade, and said conversion kit further comprises washers having the same thickness as said elastic strip for attachment to said surface of said doctor blade in alignment of said holes.

14.) A conversion kit as in claim 13 wherein said washers have adhesive on one side for securing said washers to said surface of said doctor blade.

15.) A method of converting a doctor blade of a toner hopper for an imaging machine to a spreader blade, said method comprising attaching an elastic strip to a surface of said doctor blade to evenly spread toner on a developer roller rather than scrape toner off said developer roller, said method comprising the step of withdrawing the doctor blade from contact position with toner so that only the spreader blade is in contact with the toner.

16.) A method as in claim 15 wherein said doctor blade has separators on each end to ensure a metering edge of said doctor blade does not contact said developer roller, and said method includes the step of removing said separators from said doctor blade prior to attaching said elastic strip to said surface of said doctor blade, whereby said separators do not interfere with said elastic strip.

17.) A method as in claim 15 wherein an assembly jig is used to hold said doctor blade and guide said elastic strip so said elastic strip may be accurately positioned on said doctor blade.

18.) A method as in claim 15 wherein said elastic strip is provided with a piece of two-sided tape extending along an edge of said strip, and said method includes using said two-sided tape to attach said elastic strip to said surface of said doctor blade.

19.) A method as in claim 15 wherein washers having the same thickness as said elastic strip are secured to said surface of said doctor blade at each end of said doctor blade in alignment with screw holes, wherein said surface is made even at the locations of said screw holes and said elastic strip.

* * * * *